United States Patent [19]

Richard et al.

[11] Patent Number: 4,736,816

[45] Date of Patent: Apr. 12, 1988

[54] NOISE-SUPPRESSING AIR INTAKE FOR VENTILATION FANS

[75] Inventors: Donald E. Richard, Evansville, Ind.; Dencil J. Hughes; Kenneth A. Neely, both of New Lexington, Ohio

[73] Assignee: Peabody Coal Company, St. Louis, Mo.

[21] Appl. No.: 944,411

[22] Filed: Dec. 19, 1986

[51] Int. Cl.[4] ..... F01N 7/00

[52] U.S. Cl. ..... 181/225; 181/264; 181/282

[58] Field of Search ..... 181/224–226, 181/202, 277, 282, 264

[56] References Cited

U.S. PATENT DOCUMENTS 1,380,473 6/1921 Guarniery ..... 181/202 X 4,596,921 6/1986 Hersh et al. ..... 181/225 X

*Primary Examiner*—Benjamin R. Fuller

*Attorney, Agent, or Firm*—Senniger, Powers, Leavitt and Roedel

[57] ABSTRACT

A noise-suppressing air intake for a ventilation fan comprising a base having at least one sidewall and an open top and a cap positioned over the base with a portion of the cap being aligned with a portion of the base, and another portion of the cap overlapping a portion of the sidewall of the base to define a downwardly-facing, shielded air inlet therebetween. An air outlet is located in the aligned portions of the cap and base.

13 Claims, 4 Drawing Sheets

NOISE-SUPPRESSING AIR INTAKE FOR VENTILATION FANS

BACKGROUND OF THE INVENTION

This invention relates to a noise-suppressing air intake for ventilation fans, and in particular to such intakes for mine ventilation fans.

Large high speed fans are needed to move the large volume of air required in certain ventilation applications, such as for underground mines. These high speed fans generate blade noise in discrete frequency bands that are proportional to the number of fan blades and the fan speed. In the case of a mine ventilating fan, which runs continuously, the surface noise can be very disturbing to the people living and working nearby.

Most devices for reducing fan noise also reduce air pressure, putting additional load on the fan and requiring more energy to maintain the same flow rate. Thus there are competing considerations between noise reduction and minimizing pressure loss. Noise reduction devices now in use typically provide long tapering air intakes lined with acoustic material. These devices are very large, and consequently very expensive.

SUMMARY OF THE INVENTION

Among the objects of the present invention is the provision of an air intake for a ventilation fan that reduces fan noise; the provision of such a device that is compact; the provision of such a device that is of simple and inexpensive construction; and the provision of such a device that is resistant to the weather.

Generally, the intake of the present invention comprises a base having at least one sidewall with an open top, and a cap positioned over the base with one portion of the cap being aligned with a portion of the base, and another portion of the cap overlapping a portion of the sidewall of the base to define a downwardly-facing, shielded air inlet therebetween. An air outlet is located in the aligned portions of the cap and base. The intake also includes a plurality of baffles positioned inside the intake to cause the air entering the inlets to turn at least once before exiting the outlet. The baffles and the interior surfaces of the intake are covered with a sound-absorbing material.

The intake is thus very compact and of simple and inexpensive construction. The air inlet faces downwardly and is shielded, making the device resistant to the weather. The baffles and the sound-absorbing material provide acoustically lined air pathways and turns that result in significant noise reduction.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
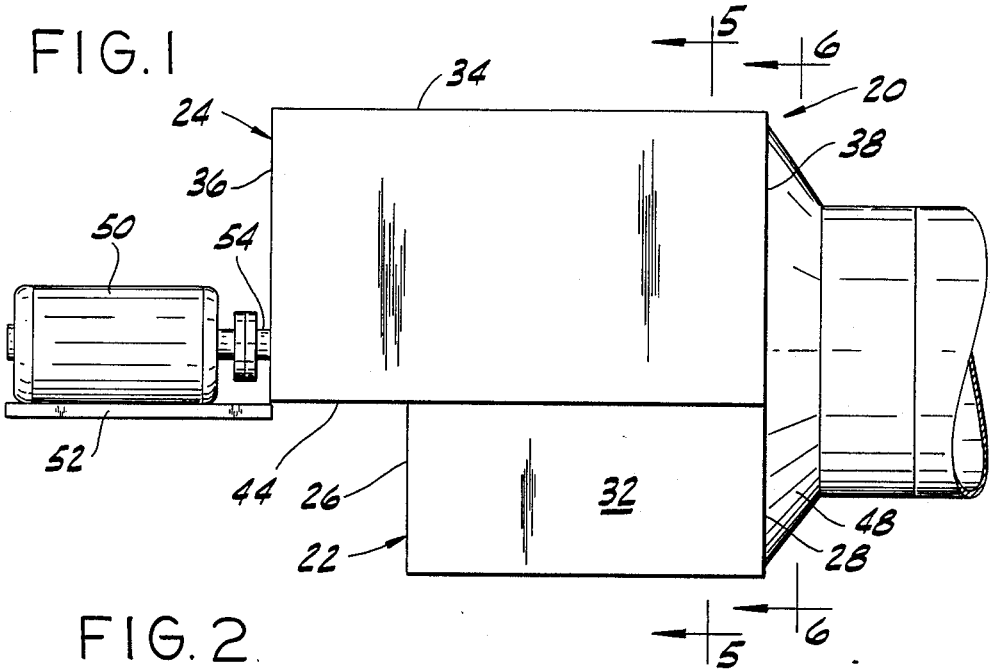
FIG. 1 is a right side elevation view of an air intake constructed according to the principles of this invention.
Figure 2:
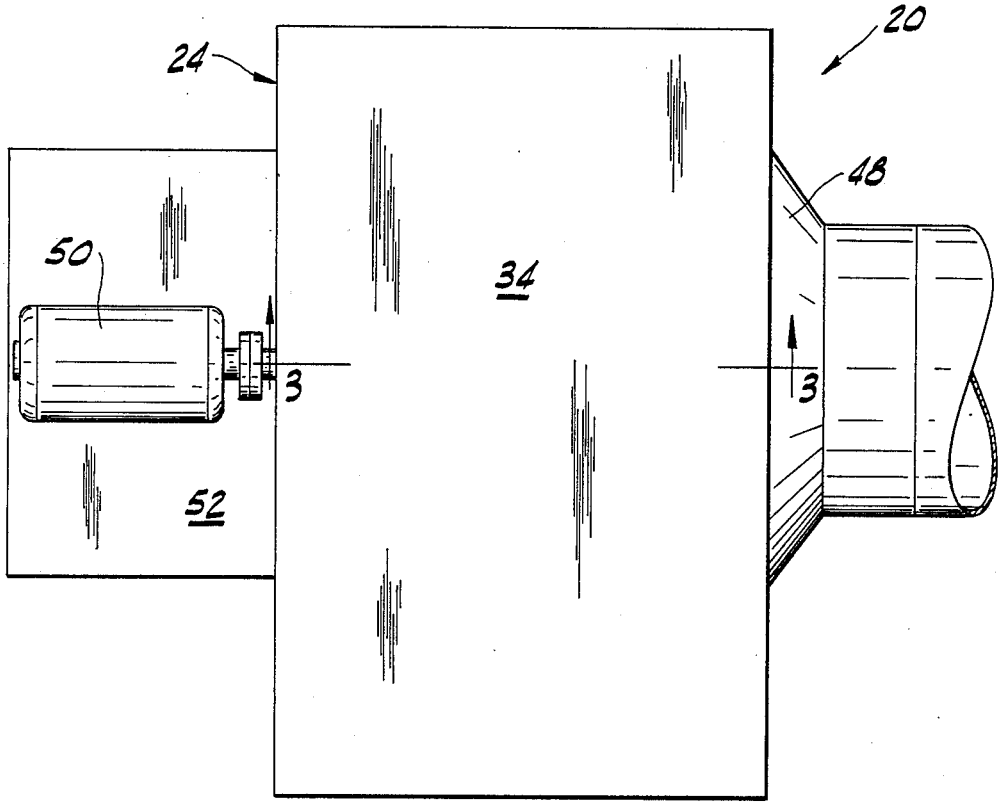
FIG. 2 is a top plan view of the intake.
Figure 3:
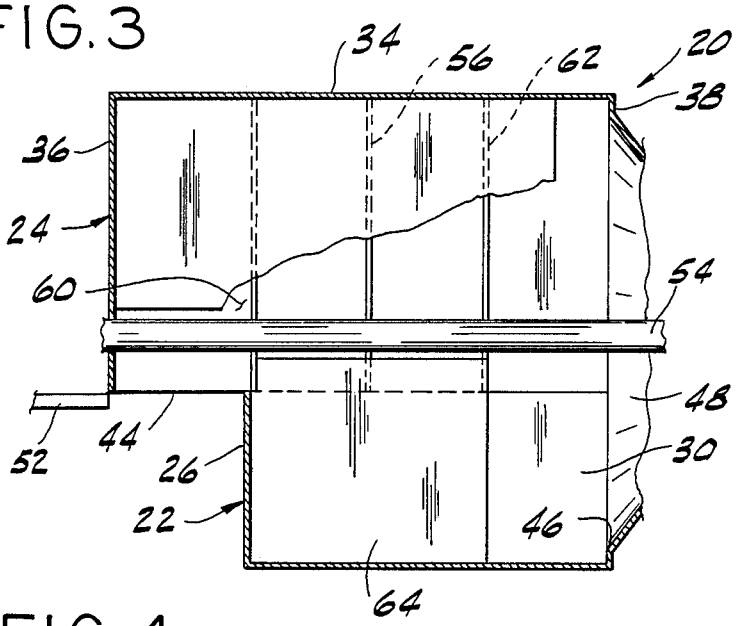
FIG. 3 is a cross-sectional view taken along the plane of line 3—3 in FIG. 2 showing the baffles inside.

A noise-suppressing air intake for a ventilation fan constructed according to the principles of this invention is indicated generally as 20 in FIGS. 1–5. The intake 20 comprises a base 22 and a cap 24. Base 22 is generally rectangular, and generally cup-shaped, comprising front wall 26, back wall 28 and left and right sidewalls 30 and 32, defining an open top. Cap 24 is also generally rectangular comprising a top panel 34 and front wall 36, back wall 38, and left and right sidewalls 40 and 42. Cap 24 is positioned over the base with the back wall 38 of the cap alligned with the back wall 28 of the base, and the other walls of the cap extending radially outwardly beyond the walls of the base to define a downwardly-facing, shielded air inlet 44 therebetween. The walls of the cap preferably overlap the walls of the base so that the air entering the intake passes between the walls of the base and cap for at least a portion. The overlap also helps to protect the interior of the intake from the weather. An air outlet 46 is formed in the alligned, co-planar backwalls of the cap and base.

An air conduit 48 extends from the air outlet 46. A fan motor 50 is mounted on a support 52 at the front of the intake 20. A drive shaft 54 extends from motor 50 through intake 20 to the air conduit 48. Fan blades (not shown) are mounted on the shaft 54 in the conduit. The fan draws air into the intake 20 though inlet 44 and out of the intake through outlet 46.

There are a plurality of baffles disposed inside the intake 20 to cause the air entering from the inlet 44 to turn at least one time before leaving the outlet. A transverse baffle 56 extends across cap 24 from left side 40 to right side 42, generally parallel to back wall 38. Baffle 56 is spaced from the front wall of the base about one-third of the distance between to the front and back walls. Baffle 56 has a cut out to receive shaft 54. The transverse baffle 56 blocks the direct passage of air from the portion of inlet 44 at the front of the intake to the outlet by deflecting the incoming air to the base 22. A longitudinal baffle 58 extends from the front wall 36 of the cap toward the back wall 38. Baffle 58 extends above shaft 54. The longitudinal baffle faces the air entering from the inlet 44 along the sides of the intake. Baffles 56 and 58 are important to turning the air entering the intake.

Figure 4:
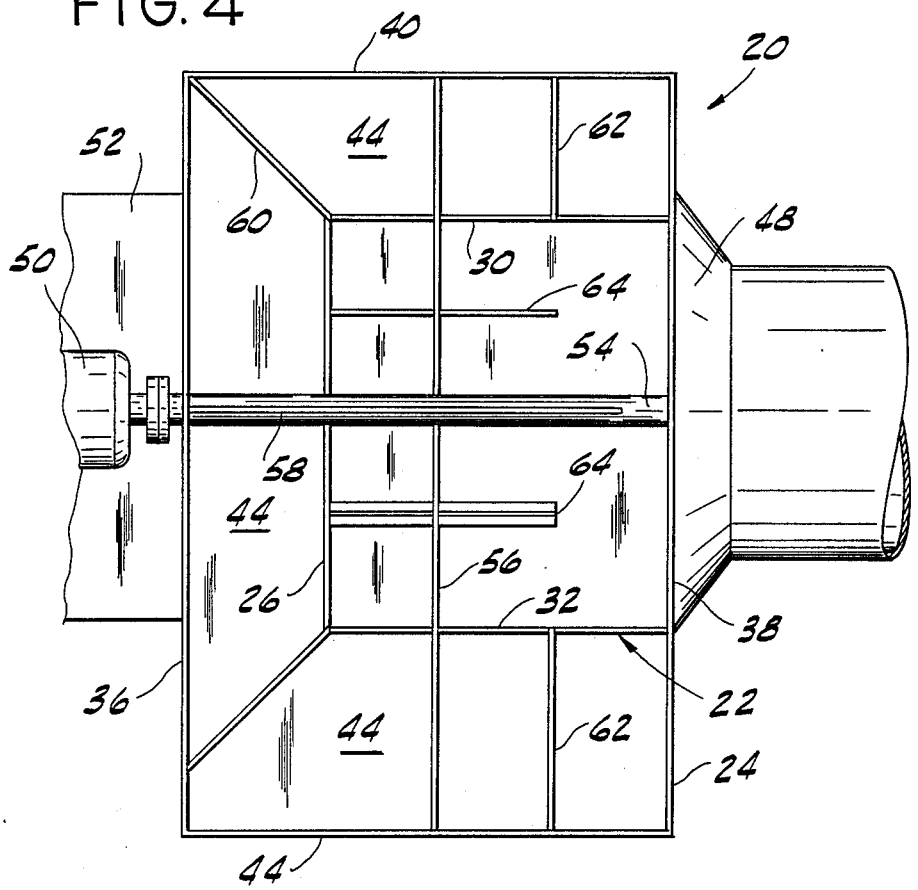
FIG. 4 is a top plan view of the intake with the top panel removed to show the baffles inside.

Additional baffles can be provided in the space between the cap and the base. A pair of baffles 60 extend generally inwardly toward the center of the intake from the front corners of the cap to the walls of the base. As shown in FIG. 4, the baffles 60 can extend from the corner or from a point near the corner. The intake 20 is preferrably made symmetric about the shaft, although as shown in the figures it can be made non-symmetric, for example to fit in a particular space. A pair of baffles 62 extend inwardly from the left and right sides of the cap to the walls of the base, parallel to the air entering from the inlet along side of the intake. Air flows generally parallel to the baffles 62 until it is turned by the longitudinal baffle 58. Finally, a pair of baffles 64 are positioned in the base, extending from the front wall 26 toward the backwall 28. Baffles 64 are generally parallel to the flow of air directed into the base from the transverse baffle 56. Additional baffles 60, 62, and 64 can be provided in the intake where deslred for example, if additional sound absorption is required or if a larger intake is constructed.

Figure 5:
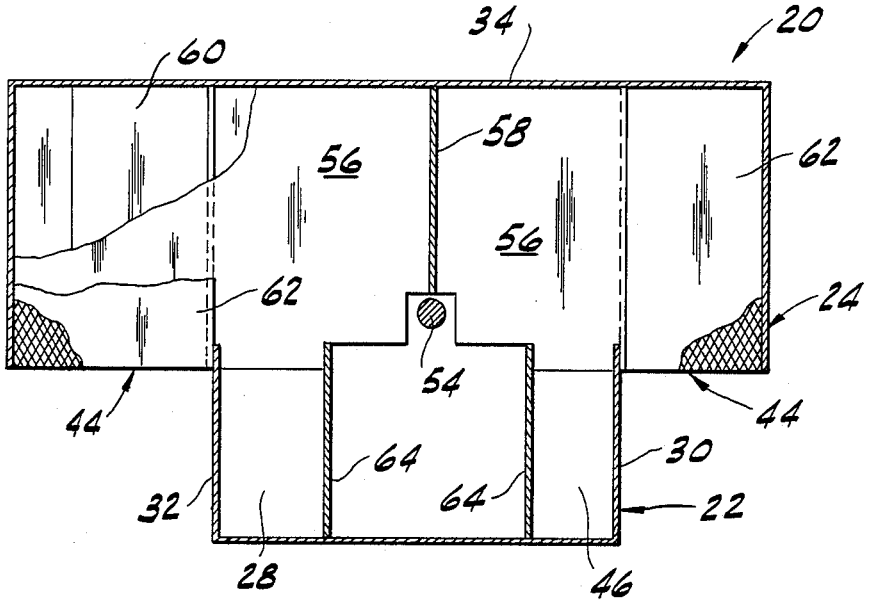
FIG. 5 is a cross-sectional view of the intake taken along the plane of line 5—5 in FIG. 3.

As shown in FIG. 5, the baffles and the interior surfaces of the intake are covered with a sound absorbing acoustic material. This material may be a vinyl-impregnated fiberglass insulating material held in place by expanded metal panels. Of course some other suitable material may be used. The thickness of the insulating material is selected for the particular frequency range of the fan noise, the lower frequencies generally requiring a thicker layer of material. The baffles thus provide acoustically lined air passages and turns to absorb the fan noise.

OPERATION

With the intake 20 properly installed, operation of the fan draws air into the intake through inlet 44 along the front and sides of the intake. Air entering the inlet along the front, directly opposite the fan, is blocked from direct passage to the outlet by the transverse baffle 56, which deflects the air into the base 22. This turning allows more sound to be absorbed. The air directed to the base flows rearwardly to the outlet between the baffles 64. The air enters the inlet along the side of the intake passes parallel to the transverse baffle 56 and baffles 62 and 64, which absorb sound and channel the air into the longitudinal baffle which deflects the air. This turning allows still more sound to be absorbed.

Figure 6:
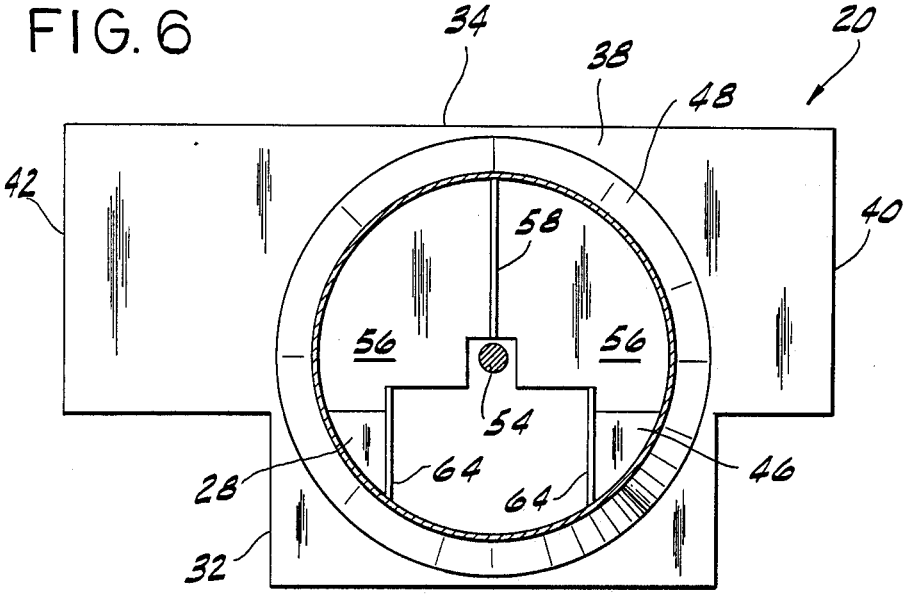
FIG. 6 is a back end (fan side) elevation view of the intake.
Figure 7:
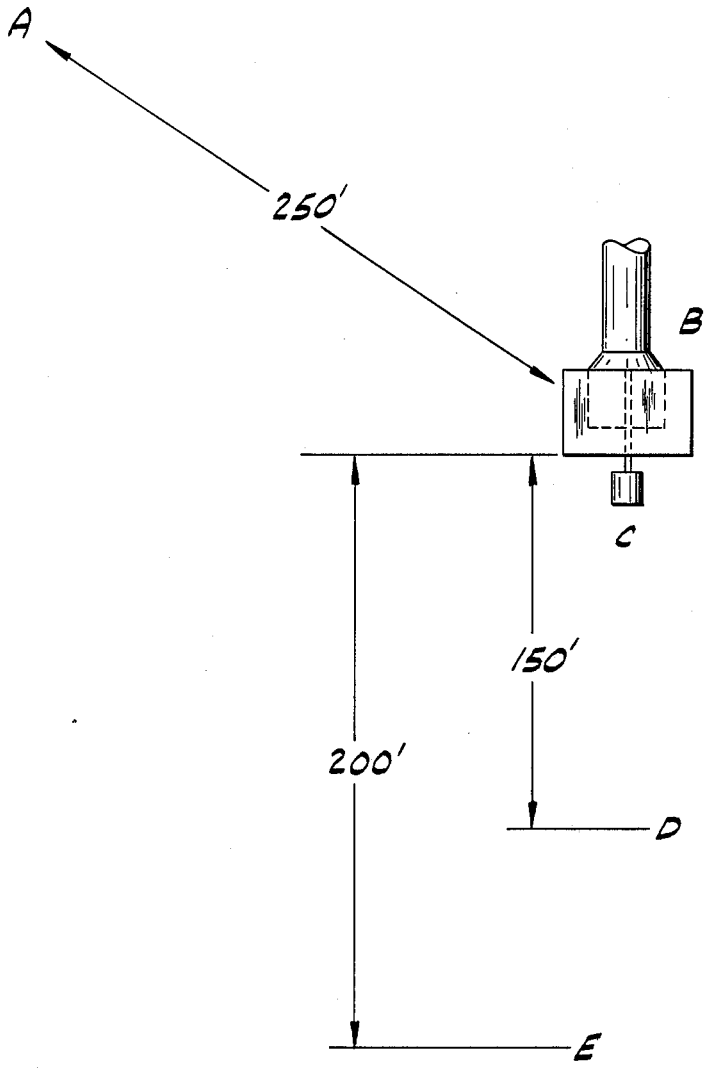
FIG. 7 is a schematic of the locations of noise measurements taken before and after the installation of the air intake.

FIG. 6 illustrates the various locations where noise readings were taken before and after installation of an air intake constructed according to the principles of this invention. These readings are are reproduced in Table I.

TABLE I

| LOCATION | BEFORE | AFTER |
|---|---|---|
| A | 76.5 dBA | 63.0 dBA |
| B | 102.0 dBA | 102.0 dBA |
| C | 114.5 dBA | 93.5 dBA |
| D | 90.0 dBA | 74.5 dBA |
| E | 74.5 dBA | 65.0 dBA |

Thus in each instance, except directly adjacent the fan, noise was reduced with the new intake device.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A noise-suppressing air intake for a ventilation fan comprising:

a base having a continuous sidewall and an open top;

a cap, having a continuous sidewall and a closed top, positioned over the open top of the base with a portion of the sidewall of the cap aligned with a portion of the sidewall of the base, and another portion of the sidewall of the cap overlapping another portion of the sidewall of the base to define a downwardly-facing, shielded air inlet therebetween; and an air outlet in the aligned portions of the sidewalls of the cap and base.

2. The device according to claim 1 further comprising a plurality of baffles positioned inside the intake to cause the air entering the inlet to turn at least once before exiting the outlet.

3. The device according to claim 2 wherein at least a portion of the air inlet is opposite the air outlet, and wherein the baffles comprise a transverse baffle extending across the cap to block the direct passage of air from the inlet to the outlet.

4. The device according to claim 3 wherein the baffles further comprise a longitudinal baffle, extending generally perpendicular to the transverse baffle.

5. The device according to claim 4 wherein the baffles further comprise a plurality of baffles arranged parallel to the air entering the inlet.

6. The device according to claim 3 wherein the baffles and the interior surfaces of the intake are covered with a sound absorbing material.

7. The device according to claim 1 wherein the sidewall of the base comprises a plurality of sides, and wherein the sidewall of the cap comprises a plurality of sides, one of which is aligned with a side of the base.

8. The device according to claim 7 wherein the cap overlaps the base on all sides except one.

9. A noise-suppressing air intake for a ventilation fan, comprising:

a generally rectangular base having a front, a back, two sides, and an open top;

a generally rectangular cap having a front, a back, and two sides, the cap positioned over the base with the back of the cap aligned with the back of the base, and the front and the sides of the cap overlapping the front and the sides of the base to define a downwardly-facing, shielded air inlet therebetween;

an air outlet in the aligned backs of the base and cap;

a transverse baffle extending across the cap between the sides, generally parallel to the back to block the direct passage of air from the inlet at the front of the cap to the outlet by deflecting the air into the base.

10. The device according to claim 9 further comprising at least one baffle in the base extending from the front to the back to channel the air deflected into the base toward the outlet.

11. The device according to claim 9 further comprising a longitudinal baffle in the cap extending from the front of the cap to the back to deflect air entering the intake from the inlet along the sides of the cap.

12. The device according to claim 11 further comprising a plurality of baffles in the cap extending generally radially inwardly toward the center of the intake, parallel to the flow of air entering the inlet.

13. The device according to claim 9 wherein the interior of the intake and the baffles are lined with an acoustic material.

* * * * *